US010486935B2

(12) United States Patent
Hida

(10) Patent No.: US 10,486,935 B2
(45) Date of Patent: Nov. 26, 2019

(54) ELEVATOR DIAGNOSING DEVICE

(71) Applicant: Mitsubishi Electric Corporation, Chiyoda-ku (JP)

(72) Inventor: Masahiko Hida, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 398 days.

(21) Appl. No.: 15/533,701

(22) PCT Filed: Feb. 18, 2015

(86) PCT No.: PCT/JP2015/054457
§ 371 (c)(1),
(2) Date: Jun. 7, 2017

(87) PCT Pub. No.: WO2016/132484
PCT Pub. Date: Aug. 25, 2016

(65) Prior Publication Data

US 2017/0327342 A1 Nov. 16, 2017

(51) Int. Cl.
*B66B 1/30* (2006.01)
*B66B 5/02* (2006.01)
(Continued)

(52) U.S. Cl.
CPC ..... *B66B 1/30* (2013.01); *B66B 5/0018* (2013.01); *B66B 5/02* (2013.01); *B66B 9/00* (2013.01)

(58) Field of Classification Search
CPC ..... B66B 11/008; B66B 11/08; B66B 5/0037; B66B 5/0018; B66B 15/04; B66B 7/1223;
(Continued)

(56) References Cited

U.S. PATENT DOCUMENTS

2009/0133966 A1* 5/2009 Shibata ..... B66B 1/30 187/293
2009/0288920 A1* 11/2009 Kattainen ..... B66B 5/04 187/287

(Continued)

FOREIGN PATENT DOCUMENTS

CN 101896415 A 11/2010
EP 2 213 606 A1 8/2010

(Continued)

OTHER PUBLICATIONS

Office Action dated Mar. 21, 2019 in Chinese Patent Application No. 201580075050.9 (with unedited computer generated English translation).

(Continued)

*Primary Examiner* — Marlon T Fletcher
(74) *Attorney, Agent, or Firm* — Oblon, McClelland, Maier & Neustadt, L.L.P.

(57) ABSTRACT

An elevator diagnosing device includes a hoisting machine including a sheave, around which a middle portion of a main rope suspending an elevator car is wound, and a controller controlling travel of the elevator car by controlling operation of the hoisting machine. The controller includes a car controller performing first travel control causing the elevator car to travel at a first acceleration/deceleration and second travel control causing the elevator car to travel at a second acceleration/deceleration less than the first acceleration/deceleration, a rope feed amount difference detector detecting a difference in feed amount of the main rope by rotation of the sheave when the elevator car travels equal distances under the first and second travel controls, and a determiner determining traction performance of the sheave based on the difference in the amount of feed of the main rope detected by the rope feed amount difference detector.

18 Claims, 5 Drawing Sheets

(51) Int. Cl.
*B66B 5/00* (2006.01)
*B66B 9/00* (2006.01)

(58) Field of Classification Search
CPC ..... B66B 5/04; B66B 15/02; B66B 5/0006; B66B 11/0065
See application file for complete search history.

(56) References Cited

U.S. PATENT DOCUMENTS

2010/0078267 A1* 4/2010 Hashimoto ..... B66B 1/302 187/296
2010/0155183 A1* 6/2010 Takahashi ..... B66B 1/32 187/288
2010/0258382 A1* 10/2010 Kondo ..... B66B 1/32 187/288
2011/0011681 A1* 1/2011 Kondo ..... B66B 1/285 187/247
2011/0036667 A1* 2/2011 Ueda ..... B66B 5/02 187/287
2012/0217100 A1* 8/2012 Spirgi ..... B66B 5/0037 187/393
2013/0299282 A1* 11/2013 Kugiya ..... B66B 5/0031 187/247
2014/0360817 A1* 12/2014 Putkinen ..... B66B 1/2458 187/247
2015/0251877 A1* 9/2015 Niikawa ..... B66B 5/04 187/305
2015/0291390 A1* 10/2015 Kakio ..... B66B 5/0031 187/249
2016/0145074 A1* 5/2016 Kattainen ..... B66B 5/022 187/254
2017/0029243 A1* 2/2017 Lotfi ..... B66D 5/30
2017/0327342 A1* 11/2017 Hida ..... B66B 5/02
2017/0362051 A1* 12/2017 Millet ..... B66B 1/32
2018/0265327 A1* 9/2018 Benosman ..... B66B 1/28

FOREIGN PATENT DOCUMENTS

JP 2008-290845 A 12/2008
JP 2011-32075 A 2/2011

OTHER PUBLICATIONS

Combined Office Action and Search Report dated Jul. 23, 2018 in Chinese Patent Application No. 201580075050.9, citing document AO therein, 13 pages (with unedited computer generated English translation of the Office Action and English Translation of categories of cited documents).
International Search Report dated May 19, 2015, in PCT/JP2015/054457, filed Feb. 18, 2015.

* cited by examiner

5: HOISTING MACHINE
30: CONTROL PANEL
31: CAR CONTROL SECTION
32: ROPE FEED AMOUNT DIFFERENCE DETECTION SECTION
33: STORAGE SECTION
34: DETERMINATION SECTION
35: NOTIFICATION SECTION
41: FIRST CAR TRAVEL CONTROL SECTION
42: SECOND CAR TRAVEL CONTROL SECTION

FIG. 3

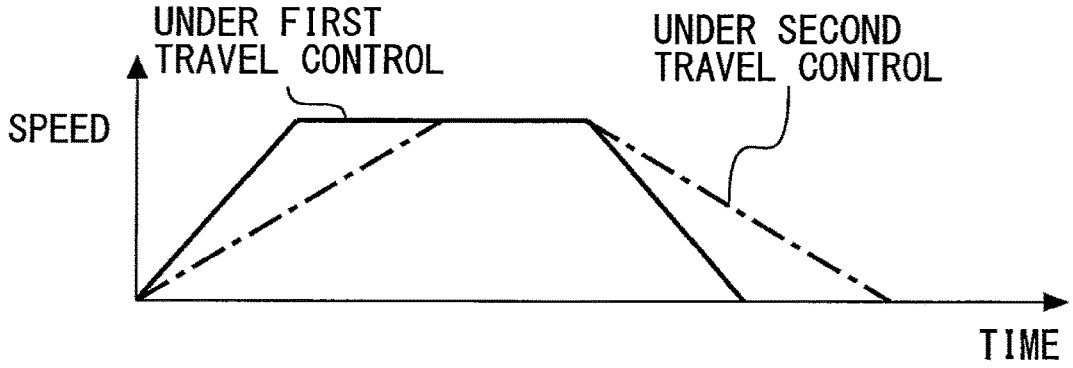

FIG. 4

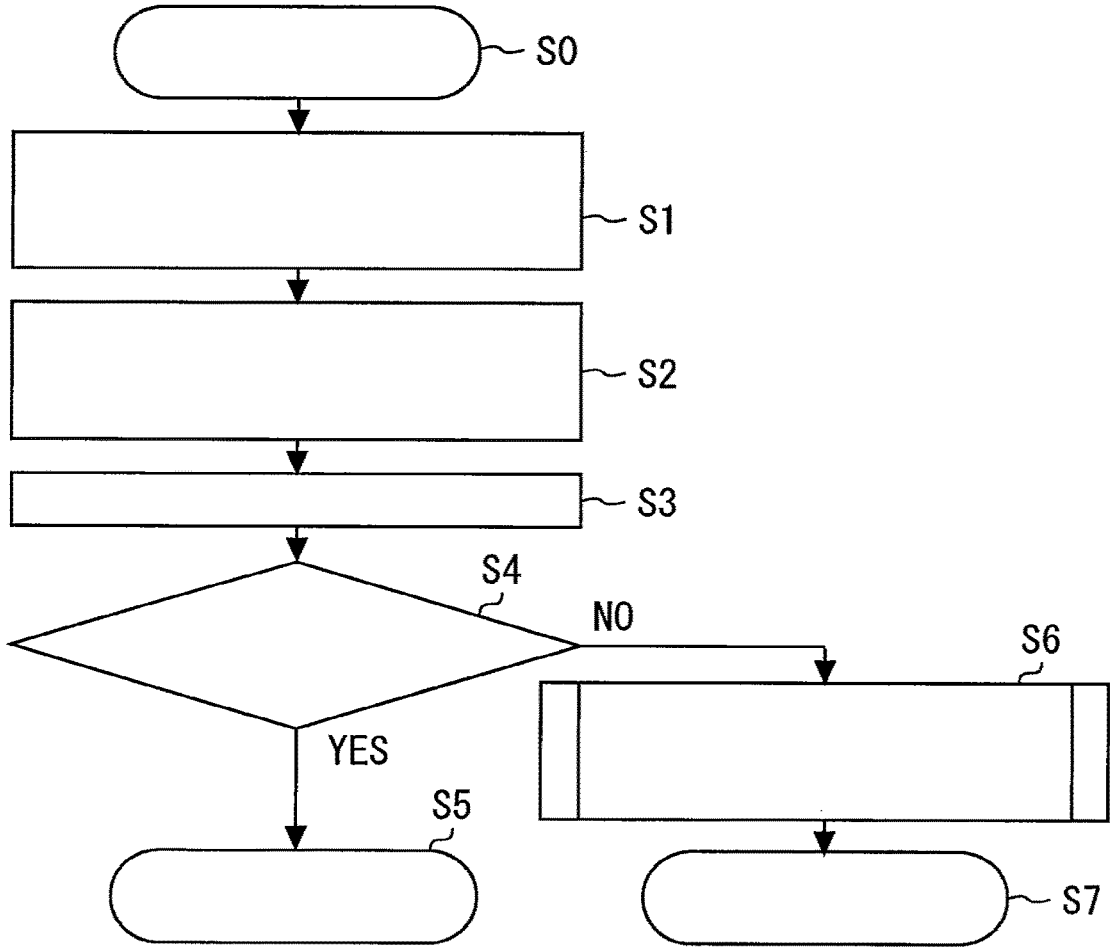

S0: START TRACTION PERFORMANCE DIAGNOSIS
S1: TRAVEL BETWEEN SET FLOORS WITH SECOND TRAVEL CONTROL (MEASURE ⊿L)
S2: TRAVEL BETWEEN SET FLOORS WITH FIRST TRAVEL CONTROL (MEASURE ⊿L1)
S3: TRACTION PERFORMANCE DIAGNOSIS
S4: OPERABLE AT RATED SPEED?
S5: CONTINUE SERVICE AT RATED SPEED
S6: <WARNING DISPLAY> NOTIFICATION OF REDUCTION OF TRACTION PERFORMANCE
S7: CONTINUE SERVICE AT LOW ACCELERATION

ELEVATOR DIAGNOSING DEVICE

TECHNICAL FIELD

The invention relates to an elevator diagnosing device.

BACKGROUND ART

In conventional elevator diagnosing devices, there is known an elevator diagnosing device in which slippage detection means for detecting a slippage amount between a drive pulley and a main cable is provided, an elevator control device performs, at the time of elevator diagnosis, rotation control of a hoisting machine based on an elevator diagnosis speed pattern, the acceleration/deceleration of the drive pulley in which is more than that of a normal speed pattern, detects the slippage amount using the slippage detection means, and performs diagnosis to determine whether or not friction between the drive pulley and the main cable is reduced based on the detected slippage amount (see, e.g., PTL 1).

In addition, in conventional elevator diagnosing devices, there is also known an elevator diagnosing device in which a first encoder disposed in a motor as motor operation monitoring means for monitoring the operational status of the motor that rotates a sheave and a second encoder disposed in a speed governor as elevating speed measurement means for measuring an elevating speed of a car are provided, a difference between a rope feed speed of the sheave based on the operational status of the motor monitored via the motor operation monitoring means and the elevating speed of the car based on a signal from the elevating speed measurement means is calculated as a rope slip speed, and the operation of the car is suspended when the rope slip speed exceeds a predetermined speed (see, e.g., PTL 2).

CITATION LIST

Patent Literature

[PTL 1] Japanese Patent Application Laid-open No. 2011-032075

[PTL 1] Japanese Patent Application Laid-open No. 2008-290845

SUMMARY OF INVENTION

Technical Problem

Incidentally, "displacement" in the relative positional relationship between the sheave and a main rope of the elevator can be caused not only by the lack of friction between the sheave and the main rope, i.e., the lack of traction performance but also by a dynamic factor of a difference in the tension of the main rope between the side of an elevator car and the side of a balance weight.

However, in the conventional elevator diagnosing devices described in PTL 1 and PTL 2, the "displacement" in the relative positional relationship between the sheave and the main rope caused by the dynamic factor is not considered. Accordingly, setting of a threshold value for determining the reduction of the traction performance may be difficult, and the diagnosis of the traction performance may become inaccurate.

In addition, in the conventional elevator diagnosing device described in PTL 1, it is necessary to provide the encoder not only in the hoisting machine (motor) but also in the speed governor, and hence its configuration is complicated and its manufacturing cost is increased.

The invention has been made in order to solve such problems, and allows obtainment of the elevator diagnosing device capable of performing more accurate diagnosis of the traction performance with a simple configuration in which the encoder is not necessary on the side of the speed governor.

Solution to Problem

An elevator diagnosing device according to the present invention includes: a hoisting machine having a sheave around which a middle portion of a main rope that suspends an elevator car is wound; and control means configured to cause the elevator car to travel by controlling an operation of the hoisting machine, wherein the control means includes: car control means configured to perform first travel control that causes the elevator car to travel at a first acceleration/deceleration and second travel control that causes the elevator car to travel at a second acceleration/deceleration, the second acceleration/deceleration being less than the first acceleration/deceleration; rope feed amount difference detection means configured to detect a difference in an amount of feed of the main rope by rotation of the sheave when the elevator car is caused to travel equal distances under the first travel control and under the second travel control; and determination means configured to determine traction performance of the sheave, based on the difference in the amount of feed of the main rope detected by the rope feed amount difference detection means.

Or an elevator diagnosing device according to the present invention includes: a hoisting machine having a sheave around which a middle portion of a main rope that suspends an elevator car is wound; and control means configured to cause the elevator car to travel by controlling an operation of the hoisting machine, wherein the control means includes: car control means configured to perform first travel control that causes the elevator car to travel with a first acceleration/deceleration time and second travel control that causes the elevator car to travel with a second acceleration/deceleration time, the second acceleration/deceleration time being shorter than the first acceleration/deceleration time; rope feed amount difference detection means configured to detect a difference in an amount of feed of the main rope by rotation of the sheave when the elevator car is caused to travel equal distances under the first travel control and under the second travel control; and determination means configured to determine traction performance of the sheave, based on the difference in the amount of feed of the main rope detected by the rope feed amount difference detection means.

Advantageous Effects of Invention

In the elevator diagnosing device according to the invention, the effect is achieved that it is possible to perform the more accurate diagnosis of the traction performance with the simple configuration.

BRIEF DESCRIPTION OF THE DRAWINGS

FIG. 3 is a view for explaining first and second travel controls of the elevator diagnosing device according to Embodiment 1 of the present invention.

FIG. 4 is a flowchart showing the operation of the elevator diagnosing device according to Embodiment 1 of the present invention.

DESCRIPTION OF EMBODIMENTS

Figure 1:
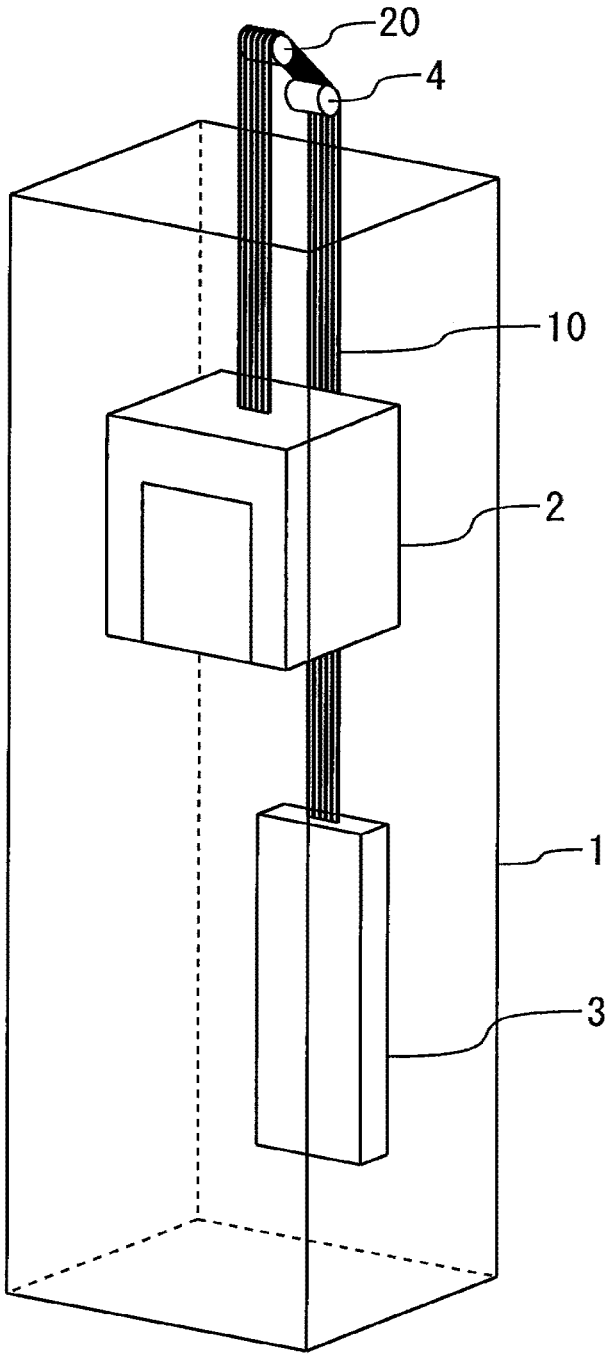
FIG. 1 is a perspective view schematically showing the overall configuration of an elevator to which an elevator diagnosing device according to Embodiment 1 of the present invention is applied.

The invention will be described with reference to the accompanying drawings. In each drawing, the same or corresponding parts are designated by the same reference numerals. Duplicate description of the parts designated by the same reference numerals will be appropriately simplified or omitted.

Embodiment 1

Figure 2:
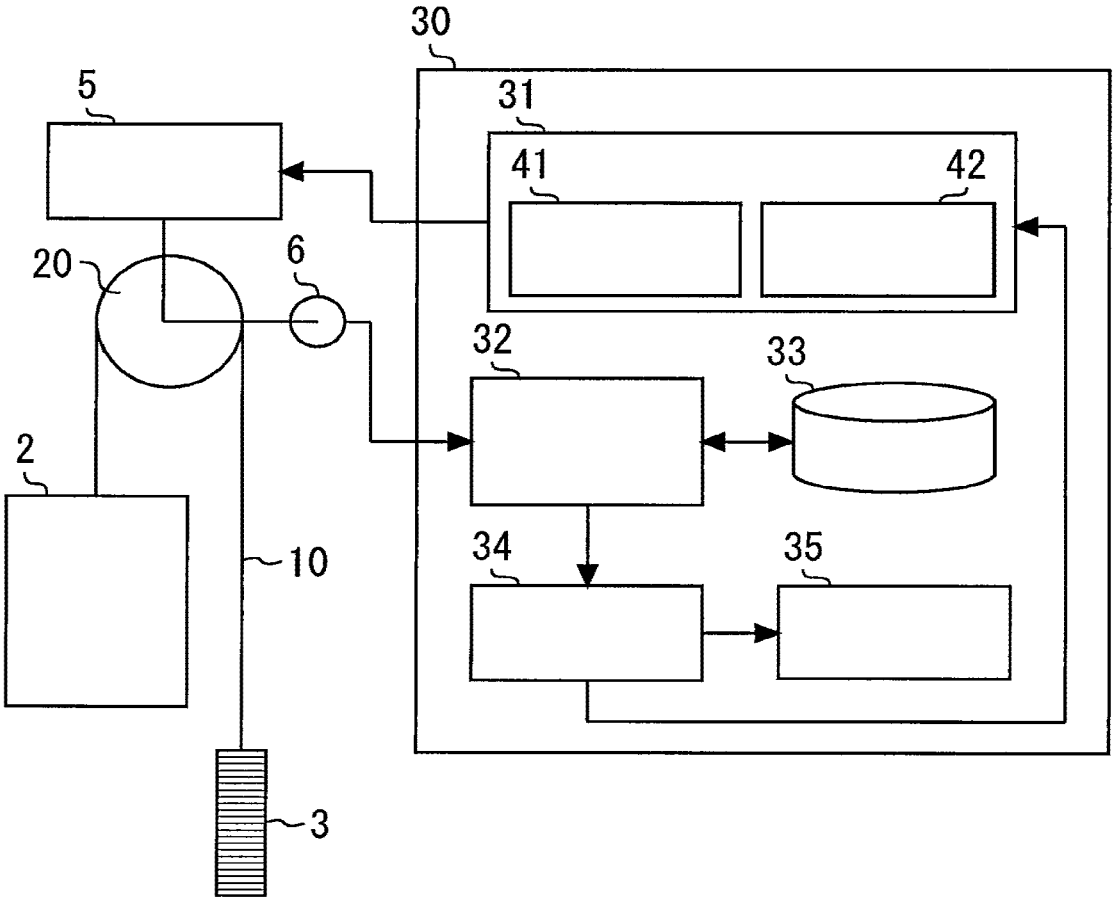
FIG. 2 is a functional block diagram showing the configuration of the elevator diagnosing device according to Embodiment 1 of the present invention.

FIGS. 1 to 4 relate to Embodiment 1 of the invention. FIG. 1 is a perspective view schematically showing the overall configuration of an elevator to which an elevator diagnosing device is applied, FIG. 2 is a functional block diagram showing the configuration of the elevator diagnosing device, FIG. 3 is a view for explaining first and second travel controls of the elevator diagnosing device, and FIG. 4 is a flowchart showing the operation of the elevator diagnosing device.

As shown in FIG. 1, an elevator car 2 is disposed in a shaft 1 of an elevator. The elevator car 2 is guided by a guide rail that is not shown to move up and down in the shaft. One end of a main rope 10 is coupled to the upper end of the elevator car 2. The other end of the main rope 10 is coupled to the upper end of a balance weight 3. The balance weight 3 is disposed in the shaft 1 so as to be capable of moving up and down.

The middle portion of the main rope 10 is wound around a sheave 20 of a hoisting machine 5 (not shown in FIG. 1) disposed at the top portion of the shaft 1. In addition, the middle portion of the main rope 10 is also wound around a deflector sheave 4 provided adjacent to the sheave 20 at the top portion of the shaft 1. In this manner, the elevator car 2 and the balance weight 3 are suspended by the main rope 10 in well bucket manner so as to move up and down in mutually opposite directions in the shaft 1. That is, the elevator to which the elevator diagnosing device according to the invention is applied is a so-called traction type elevator.

Next, with reference to FIG. 2, the configuration that includes a control system of the elevator diagnosing device will be further described. The hoisting machine 5 rotationally drives the sheave 20. When the hoisting machine 5 rotates the sheave 20, the main rope 10 moves with friction between the main rope 10 and the sheave 20. When the main rope 10 moves, the elevator car 2 and the balance weight 3 suspended by the main rope 10 move up and down in mutually opposite directions in the shaft 1.

The operation of the hoisting machine 5 is controlled by a control panel 30. That is, the control panel 30 is control means for causing the elevator car 2 to travel by controlling the operation of the hoisting machine 5. The control of the hoisting machine 5 for causing the elevator car 2 to travel is governed particularly by a car control section 31 of the control panel 30. The car control section 31 includes a first car travel control section 41 and a second car travel control section 42.

The first car travel control section 41 performs first travel control. The first travel control is the control that causes the elevator car 2 to travel at a preset first acceleration/deceleration. The second car travel control section 42 performs second travel control. The second travel control is the control that causes the elevator car 2 to travel at a preset second acceleration/deceleration. Herein, the second acceleration/deceleration is set so as to be less than the first acceleration/deceleration.

The car control section 31 constitutes car control means for performing the first travel control that causes the elevator car 2 to travel at the first acceleration/deceleration and the second travel control that causes the elevator car to travel at the second acceleration/deceleration that is less than the first acceleration/deceleration by including the first car travel control section 41 and the second car travel control section 42. Note that the car control section 31 also performs general controls related to the elevator car 2 other than the travel of the elevator car 2 such as a control for opening and closing a door of the elevator car 2.

The control panel 30 further includes a rope feed amount difference detection section 32. The rope feed amount difference detection section 32 detects a difference in the amount of feed of the main rope 10 by rotation of the sheave 20 when the elevator car 2 is caused to travel equal distances under the first travel control and under the second travel control.

The operation in which the elevator car 2 is caused to travel equal distances under the first travel control and under the second travel control will be described with reference to FIG. 3. FIG. 3 is a graph showing the relationship between an elapsed time and the speed of the elevator car 2 during the first travel control and the second travel control. In FIG. 3, the horizontal axis is a time axis, while the vertical axis is a speed axis. In the graph in FIG. 3, the speed change of the elevator car 2 during the first travel control is indicated by a solid line, and the speed change of the elevator car 2 during the second travel control is indicated by a one-dot chain line.

As shown in FIG. 3, during the first travel control, when the elevator car 2 departs from a departure floor, first, the elevator car 2 is accelerated at the first acceleration/deceleration. When the speed of the elevator car 2 reaches a predetermined rated speed, the acceleration is stopped. The elevator car 2 travels at a constant speed having the rated speed as the maximum speed. When the elevator car 2 passes through a position a predetermined distance short of a stop floor, the elevator car 2 is decelerated at the first acceleration/deceleration. Subsequently, the elevator car 2 stops at the stop floor.

During the second travel control, when the elevator car 2 departs from the departure floor, first, the elevator car 2 is accelerated at the second acceleration/deceleration. When the speed of the elevator car 2 reaches the rated speed, the acceleration is stopped. The elevator car 2 travels at the constant speed having the rated speed as the maximum speed. That is, the maximum speed in the second travel control is the rated speed similarly to the case of the first travel control.

When the elevator car 2 passes through a position a predetermined distance short of the stop floor, the elevator car 2 is decelerated at the second acceleration/deceleration. Subsequently, the elevator car 2 stops at the stop floor. Herein, as described above, the second acceleration/deceleration is less than the first acceleration/deceleration. Accordingly, a time required for the elevator car 2 to reach the rated speed from the departure from the departure floor and a time from the start of the deceleration to the stop at the stop floor, i.e., an acceleration/deceleration time is longer in the second travel control than in the first travel control.

Causing the elevator car 2 to travel equal distances under the first travel control and under the second travel control denotes that the distance from the departure floor to the stop floor during the first travel control is equal to the distance from the departure floor to the stop floor during the second travel control. That is, in FIG. 3, an area surrounded by the graph of the speed change during the first travel control and the time axis is equal to an area surrounded by the graph of the speed change during the second travel control and the time axis. In order to implement the travel described above, specifically, for example, it is only necessary to use the same departure floor and the same stop floor in the first travel control and in the second travel control.

The description will be continued with reference to FIG. 2 again. In order to detect the rotation of the sheave 20, an encoder 6 is provided. The encoder 6 outputs, e.g., a pulse signal in accordance with a rotational phase angle of the sheave 20. By counting the number of pulses of the pulse signal outputted from the encoder 6, it is possible to detect the number of rotations of the sheave 20 and the rotational phase angle of the sheave 20.

The rope feed amount difference detection section 32 detects the difference in the amount of feed of the main rope 10 by the rotation of the sheave 20 based on a difference in the number of rotations of the sheave 20 when the elevator car 2 is caused to travel equal distances under the first travel control and under the second travel control. That is, the rope feed amount difference detection section 32 detects the difference in the amount of feed of the main rope 10 by using the detection result of the encoder 6.

Specifically, first, the rope feed amount difference detection section 32 causes a storage section 33 of the control panel 30 to store the number of rotations of the sheave 20 detected by the encoder 6 when the elevator car 2 is caused to travel from the departure floor to the stop floor under the second travel control. Next, the rope feed amount difference detection section 32 determines a difference between the number of rotations of the sheave 20 detected by the encoder 6 when the elevator car 2 is caused to travel from the departure floor to the stop floor under the first travel control and the number of rotations of the sheave 20 during the second travel control stored in the storage section 33. Subsequently, for example, the rope feed amount difference detection section 32 can calculate the difference in the amount of feed of the main rope 10 by the rotation of the sheave 20 by multiplying the determined difference in the number of rotations of the sheave 20 by the circumferential length of the sheave 20.

A determination section 34 of the control panel 30 determines traction performance of the sheave 20 based on the difference in the amount of feed of the main rope 10 detected by the rope feed amount difference detection section 32 in this manner. Principles of the determination of the traction performance by the determination section 34 will be described next.

The traction type elevator converts the rotation of the sheave 20 to the movement of the main rope 10 with friction generated between the sheave 20 and the main rope 10 to thereby cause the elevator car 2 to move up and down. When the friction generated between the sheave 20 and the main rope 10 becomes insufficient, "slippage" occurs between the sheave 20 and the main rope 10. A state in which the "slippage" is present between the sheave 20 and the main rope 10 corresponds to a state in which the traction performance is insufficient.

In order to determine the traction performance of the sheave 20, it is only necessary to determine whether or not the "slippage" is present between the sheave 20 and the main rope 10. However, "displacement" in the relative positional relationship between the sheave 20 and the main rope 10 is caused not only by the lack of the traction performance but also by a dynamic factor described next.

That is, when the elevator car 2 is moved in a state in which a difference in the tension of the main rope 10 between the side of the elevator car 2 and the side of the balance weight 3 is present, slight "displacement" inevitably occurs in the relative positions of the sheave 20 and the main rope 10 due to a difference in the elongation amount of the main rope 10 resulting from the tension difference. This phenomenon inevitably occurs dynamically due to a tension change of the main rope 10 when the main rope 10 moves so as to be extended between the side of the elevator car 2 and the side of the balance weight 3 of the sheave 20. The amount of the "displacement" caused by the phenomenon in the case where the elevator car 2 is caused to perform a reciprocal operation in a 1:1 roping elevator can be represented by the following (1) Expression.

$$\Delta L = L \cdot \{\Delta W / (A \cdot E)\} \tag{1}$$

Note that, in (1) Expression, ΔL is the amount of the slight "displacement" in the relative positions of the sheave 20 and the main rope 10, L is an inter-floor distance of the reciprocal operation of the elevator car 2, ΔW is a mass difference (tension difference) between the side of the elevator car 2 and the side of the balance weight 3, A is a cross-sectional area of the main rope 10 (an area of a steel wire), and E is an elastic modulus of the main rope 10.

In order to accurately diagnose the traction performance of the elevator, it is necessary to consider the "displacement" in the relative positions of the sheave 20 and the main rope 10 caused by the above phenomenon. Herein, according to (1) Expression, even in the case where the elevator car 2 is caused to travel the same inter-floor distance L, when ΔW, A, or E as the other variable differs, the amount ΔL of the "displacement" differs. Consequently, the amount ΔL of the "displacement" differs from one elevator to another.

Incidentally, it is possible to determine whether or not the traction performance of the sheave 20 of the elevator is sufficiently high to such an extent that the "slippage" does not occur between the sheave 20 and the main rope 10 by the following (2) Expression.

$$\exp(k \cdot \mu \cdot \theta) \geq \{W\mathrm{car} \cdot (g+\alpha)\} / \{W\mathrm{cwt} \cdot (g-\alpha)\} \tag{2}$$

In (2) Expression, exp (x) means the base e of natural logarithm raised to the power x. k is a groove coefficient, and is a value that is geometrically determined based on the shape of the groove of the sheave 20 around which the main rope 10 is wound. In addition, μ is a coefficient of friction between the sheave 20 and the main rope 10, θ is a contact angle, and the contact angle is an angle of the main rope 10 wound around the sheave 20. Further, Wcar is the mass of the side of the elevator car 2, Wcwt is the mass of the side of the balance weight 3, g is acceleration of gravity, and α is an acceleration/deceleration during the operation of the elevator car 2 of the elevator.

When (2) Expression is established, the traction performance of the sheave 20 is high enough to prevent the occurrence of the "slippage" between the sheave 20 and the main rope 10. On the other hand, in the case where (2) Expression is not established, the traction performance of the sheave 20 is low, and the "slippage" occurs between the sheave 20 and the main rope 10.

Herein, according to (2) Expression, the smaller the value of the acceleration/deceleration $\alpha$ of the elevator car 2 is, the smaller the value of the right side of (2) Expression is. In addition, the smaller the value of the right side of (2) Expression is, the more likely the inequality sign of (2) Expression is to be established. Consequently, even when the traction performance is reduced, by reducing the value of the acceleration/deceleration $\alpha$ of the elevator car 2, it is possible to create a state in which only the "displacement" caused by the dynamic factor represented by (1) Expression occurs without the occurrence of the "slippage" between the sheave 20 and the main rope 10.

Note that, when consideration is given to the fact that the traction performance of the elevator is gradually reduced due to wear of the groove of the sheave 20 or the like, in a situation where the occurrence of the "slippage" is started with the normal acceleration/deceleration (the first acceleration/deceleration), there is a high probability that the "slippage" does not occur yet with the acceleration/deceleration that is less than the normal acceleration/deceleration (the second acceleration/deceleration).

Accordingly, as described above, in the elevator diagnosing device according to Embodiment 1 of the invention, the rope feed amount difference detection section 32 detects the difference in the amount of feed of the main rope 10 by the rotation of the sheave 20 when the elevator car 2 is caused to travel equal distances under the first travel control and under the second travel control.

In the second travel control, the elevator car 2 is caused to travel at the second acceleration/deceleration that is less than the first acceleration/deceleration in the first travel control. Consequently, because of the reason described above, even when the "slippage" is present during the first travel control, it is possible to consider that the amount of feed of the main rope 10 during the second travel control reflects only the "displacement" caused by the dynamic factor represented by (1) Expression.

Accordingly, the difference in the amount of feed of the main rope 10 detected by the rope feed amount difference detection section 32 is the amount of the "slippage" between the main rope 10 and the sheave 20 caused by the reduction of the traction performance from which the "displacement" caused by the dynamic factor represented by (1) Expression is excluded. The determination section 34 determines the traction performance of the sheave 20 based on the difference in the amount of feed of the main rope 10 detected by the rope feed amount difference detection section 32.

That is, it can be seen that, when there is no difference in the amount of feed of the main rope 10 between the first travel control and the second travel control, the "slippage" is not present between the main rope 10 and the sheave 20, and the traction has no problem. However, even when the travel distances of the elevator car 2 are equal to each other, in the case where the traction performance is reduced, the number of rotations of the sheave 20 during the first travel control is changed and the amount of the "displacement" is increased. That is, the "slippage" occurs. As a result, a difference is generated in the amount of feed of the main rope 10 between the first travel control and the second travel control. By presetting the allowable amount of the "slippage" and periodically measuring the traction performance by using the allowable amount as the reference value, it is possible to prevent traction failure.

Thus, the determination section 34 can determine the traction performance of the sheave 20 based on the amount of the "slippage" between the main rope 10 and the sheave 20 caused by the reduction of the traction performance from which the "displacement" caused by the dynamic factor represented by (1) Expression is excluded. Specifically, for example, in the case where the difference in the amount of feed of the main rope 10 detected by the rope feed amount difference detection section 32 is not less than a preset reference value, the determination section 34 determines that the traction performance of the sheave 20 is lower than a predetermined reference.

As the unit of the amount of feed of the main rope 10 used in the rope feed amount difference detection section 32 and the determination section 34, the number of rotations of the sheave 20 may also be used as the unit without performing the multiplication by the circumferential length of the sheave 20.

In the case where it is determined that the traction performance of the sheave 20 is lower than the predetermined reference by the determination section 34, the car control section 31 causes the elevator car 2 to travel at the acceleration/deceleration that is less than the acceleration/deceleration during a normal operation. For example, when it is assumed that the first acceleration/deceleration is the acceleration/deceleration during the normal operation, after it is determined that the traction performance of the sheave 20 is lower than the reference by the determination section 34, the car control section 31 causes the elevator car 2 to travel at the second acceleration/deceleration.

Alternatively, after it is determined that the traction performance of the sheave 20 is lower than the predetermined reference by the determination section 34, the car control section 31 causes the elevator car 2 to travel at the maximum speed that is lower than the maximum speed during the normal operation. That is, after it is determined that the traction performance of the sheave 20 is lower than the predetermined reference by the determination section 34, the car control section 31 causes the elevator car 2 to travel at the maximum speed that is lower than the rated speed during the normal operation.

The control panel 30 includes a notification section 35. In the case where it is determined that the traction performance of the sheave 20 is lower than the reference by the determination section 34, the notification section 35 notifies a management office in a building in which the elevator is disposed or, e.g., an external monitoring center of the determination result.

With the operation described above, in the case where the traction performance of the sheave 20 is reduced, it is possible to prevent the occurrence of the "slippage" by reducing the acceleration/deceleration or the maximum speed as an emergency action, and issue a notification that maintenance is required to thereby encourage an appropriate response.

Next, with reference to FIG. 4, the flow of the operation of the traction performance diagnosis by the thus configured elevator diagnosing device will be described again. First, when the control panel 30 starts the diagnosis of the traction performance in Step S0, the flow proceeds to Step S1.

Herein, the start of the diagnosis of the traction performance in Step S0 is automatically performed at the beginning of a preset time period. As the time period in which the diagnosis is started, for example, a time period in which the elevator is not used is preset. That is, the first travel control and the second travel control by the car control section 31, the detection of the difference in the amount of feed of the main rope 10 by the rope feed amount difference detection section 32, and the determination of the traction performance of the sheave 20 by the determination section 34 are performed during the preset time period in which the elevator is not used.

Alternatively, in the case where, during the time period, a state in which the elevator car 2 does not travel and a call is not registered continues for a specific time period or longer, the control panel 30 may automatically start the diagnosis of the traction performance.

In Step S1, first, the second car travel control section 42 of the car control section 31 causes the elevator car 2 to travel at the second acceleration/deceleration that is less than the first acceleration/deceleration under the second travel control. This travel is performed between the preset departure floor and the preset stop floor. Subsequently, the rope feed amount difference detection section 32 measures a rotation amount of the sheave 20 at this point based on the detection result of the encoder 6. The rotation amount of the sheave 20 corresponds to the amount of feed of the main rope 10 with respect to the sheave 20. The value of the amount of feed of the main rope measured in this manner is temporarily stored in the storage section 33 as the reference ΔL of the detection of the "slippage".

After Step S1, the flow proceeds to Step S2. In Step S2, the first car travel control section 41 of the car control section 31 causes the elevator car 2 to travel at the first acceleration/deceleration under the first travel control. This travel is performed between the preset departure floor and the preset stop floor such that the distance of the travel becomes equal to the travel distance in Step S1. Subsequently, the rope feed amount difference detection section 32 measures the rotation amount of the sheave 20 at this point, i.e., the amount of feed of the main rope 10 with respect to the sheave 20 based on the detection result of the encoder 6. The value of the amount of feed of the main rope measured in this manner is represented by ΔL1.

After Step S2, the flow proceeds to Step S3. In Step S3, the determination section 34 performs the diagnosis of the traction performance. That is, first, the determination section 34 calculates a difference (ΔL1−ΔL) between ΔL1 measured in Step S2 and ΔL that is measured and temporarily stored in the storage section 33 in Step S1. Next, the determination section 34 compares the calculated difference (ΔL1−ΔL) with a reference value. Note that the reference value is preset and pre-stored in, e.g., the storage section 33.

After Step S3, the flow proceeds to Step S4. In Step S4, the determination section 34 determines whether or not the elevator can be operated at the rated speed. That is, as the result of the comparison in Step S3, in the case where the difference (ΔL1−ΔL) is less than the reference value, the determination section 34 determines that the elevator can be operated at the rated speed. On the other hand, in the case where the difference (ΔL1−ΔL) is not less than the reference value, the determination section 34 determines that the elevator cannot be operated at the rated speed.

In the case where the determination section 34 determines that the elevator can be operated at the rated speed, the flow proceeds to Step S5. In Step S5, the elevator continues its service at the rated speed. That is, the car control section 31 causes the elevator car 2 to travel with the rated speed used as the maximum speed. Subsequently, the flow of a series of operations is ended.

On the other hand, in the case where the determination section 34 determines that the elevator cannot be operated at the rated speed, the flow proceeds to Step S6. In Step S6, the notification section 35 issues a notification that the traction performance is reduced. The issue of the notification is performed by a method that displays a warning or the like in the management office in the building, the external monitoring center or the like. Instead of the display of the warning or together with the display of the warning, the issue of the notification may also be performed by voice.

After Step S6, the flow proceeds to Step S7. In Step S7, the elevator continues its service at a low acceleration. That is, the car control section 31 causes the elevator car 2 to travel at the acceleration/deceleration that is less than the acceleration/deceleration during the normal operation. Subsequently, the flow of a series of operations is ended.

Note that the continuation of the service at the low acceleration in Step S7 is performed temporarily until a response by maintenance personnel or the like having received the notification in Step S6 is executed. After the maintenance personnel or the like having received the notification in Step S6 executes the appropriate response such as replacing the sheave 20 with the new sheave 20, the normal operation is performed. Further, in Step S7, in addition to the continuation of the service at the low acceleration by the elevator, as described above, the elevator may continue the service with the maximum speed that is lower than the maximum speed during the normal operation.

Incidentally, in the foregoing, the case where the roping method of the elevator is 1:1 roping has been described. However, the roping method is not limited to the 1:1 roping described above. That is, the elevator to which the elevator diagnosing device according to the invention is applied may have another roping method such as 2:1 roping as long as the elevator is the traction type elevator.

The thus configured elevator diagnosing device includes the hoisting machine 5 that has the sheave 20 around which the middle portion of the main rope 10 that suspends the elevator car 2 is wound, and the control panel 30 as the control means for causing the elevator car 2 to travel by controlling the operation of the hoisting machine 5. In addition, the control panel 30 as the control means includes the car control section 31 that performs the first travel control that causes the elevator car 2 to travel at the first acceleration/deceleration and the second travel control that causes the elevator car 2 to travel at the second acceleration/deceleration that is less than the first acceleration/deceleration, the rope feed amount difference detection section 32 that detects the difference in the amount of feed of the main rope 10 by the rotation of the sheave 20 when the elevator car 2 is caused to travel equal distances under the first travel control and under the second travel control, and the determination section 34 that determines the traction performance of the sheave 20 based on the difference in the amount of feed of the main rope 10 detected by the rope feed amount difference detection section 32.

Accordingly, it is possible to inexpensively and easily perform the diagnosis of the traction performance with the simple configuration in which the encoder is not necessary on the side of the speed governor. In addition, it is possible to perform the more accurate diagnosis of the traction performance that considers the "displacement" in the relative positional relationship between the sheave and the main rope caused by the dynamic factor of the difference in the tension of the main rope between the side of the elevator car and the side of the balance weight. Further, by extension, it is possible to allow the execution of more appropriate maintenance.

Embodiment 2

Figure 5:
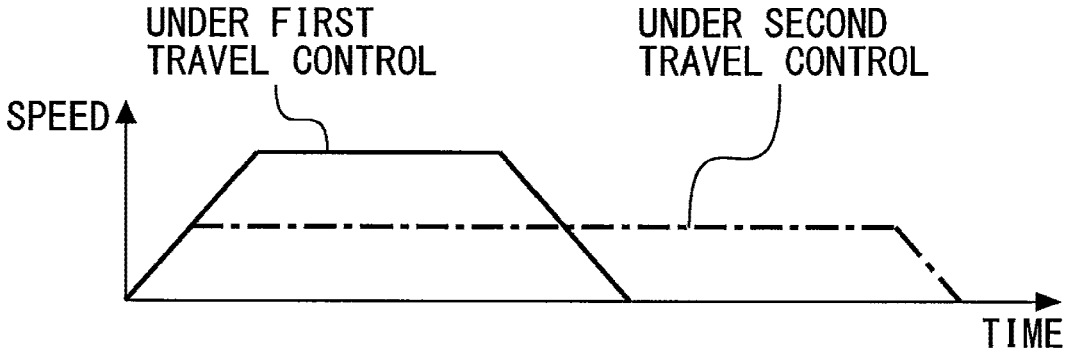
FIG. 5 is a view for explaining the first and second travel controls of the elevator diagnosing device according to Embodiment 2 of the present invention.

FIG. 5 relates to Embodiment 2 of the invention, and is a view for explaining the first and second travel controls of the elevator diagnosing device.

In Embodiment 1 described above, in order to diagnose the traction performance, the difference in the amount of feed of the main rope 10 when the elevator car 2 is caused to travel equal distances while the acceleration/deceleration is changed is detected. In contract to this, in Embodiment 2 described herein, in the configuration of Embodiment 1 described above, in order to diagnose the traction performance, the difference in the amount of feed of the main rope 10 when the elevator car 2 is caused to travel equal distances while an acceleration/deceleration time is changed is detected.

In Embodiment 2 as well, the basic configuration that includes the control system of the elevator diagnosing device is the same as that in Embodiment 1, and hence Embodiment 2 will be described with reference to FIG. 2 used in the description of Embodiment 1. The first car travel control section 41 of the car control section 31 performs the first travel control. The second car travel control section 42 of the car control section 31 performs the second travel control.

However, in Embodiment 2, unlike Embodiment 1, the first travel control is the control that causes the elevator car 2 to travel with a preset first acceleration/deceleration time. In addition, the second travel control is the control that causes the elevator car 2 to travel with a preset second acceleration/deceleration time. The second acceleration/deceleration time is set so as to be shorter than the first acceleration/deceleration time.

The car control section 31 constitutes the car control means for performing the first travel control that causes the elevator car 2 to travel with the first acceleration/deceleration time and the second travel control that causes the elevator car to travel with the second acceleration/deceleration time that is less than the first acceleration/deceleration time by including the first car travel control section 41 and the second car travel control section 42.

Similarly to Embodiment 1, the rope feed amount difference detection section 32 of the control panel 30 detects the difference in the amount of feed of the main rope 10 by the rotation of the sheave 20 when the elevator car 2 is caused to travel equal distances under the first travel control and under the second travel control.

However, in Embodiment 2, the details of the first travel control and the second travel control are different from those in Embodiment 1. Accordingly, the operation of Embodiment 2 in which the elevator car 2 is caused to travel equal distances under the first travel control and under the second travel control will be described with reference to FIG. 5. FIG. 5 is a graph showing the relationship between the elapsed time and the speed of the elevator car 2 during the first travel control and the second travel control. In FIG. 5, the horizontal axis is the time axis, while the vertical axis is the speed axis. In the graph in FIG. 5, the speed change of the elevator car 2 during the first travel control is indicated by the solid line, and the speed change of the elevator car 2 during the second travel control is indicated by the one-dot chain line.

As shown in FIG. 5, during the first travel control, when the elevator car 2 departs from the departure floor, the elevator car 2 is accelerated at a constant acceleration first. Subsequently, when the first acceleration/deceleration time has elapsed since the start of the acceleration, the acceleration of the elevator car 2 is stopped. At the point of time when the acceleration is stopped, the speed of the elevator car 2 is equal to the rated speed. Conversely, the first acceleration/deceleration time is preset so as to be equal to a time required for the elevator car 2 accelerated at the constant acceleration to reach the rated speed from its stop state.

The elevator car 2 travels at a constant speed having the rated speed as the maximum speed. When the elevator car 2 passes through a position a predetermined distance short of the stop floor, the elevator car 2 is decelerated at a constant deceleration. Subsequently, the elevator car 2 stops at the stop floor. A time required for the deceleration at this point is equal to the first acceleration/deceleration time.

During the second travel control, when the elevator car 2 departs from the departure floor, the elevator car 2 is accelerated at the constant acceleration first. Subsequently, when the second acceleration/deceleration time has elapsed since the start of the acceleration, the acceleration of the elevator car 2 is stopped. As described above, the second acceleration/deceleration time is shorter than the first acceleration/deceleration time. Consequently, at the point of time when the acceleration is stopped, the speed of the elevator car 2 is lower than the rated speed. The elevator car 2 travels at a constant speed having the speed lower than the rated speed as the maximum speed.

When the elevator car 2 passes through a position a predetermined distance short of the stop floor, the elevator car 2 is decelerated at the constant deceleration. Subsequently, the elevator car 2 stops at the stop floor. A time required for the deceleration at this point is equal to the second acceleration/deceleration time.

Thus, in the second travel control, the acceleration at the time of the departure and the deceleration at the time of the stop are performed with the second acceleration/deceleration time that is shorter than the first acceleration/deceleration time during the first travel control. The magnitude of the acceleration/deceleration at this point in the first travel control is equal to that in the second travel control. Consequently, in other words, the second travel control is the control that causes the elevator car 2 to travel at the maximum speed that is lower than the maximum speed during the first travel control.

Note that causing the elevator car 2 to travel equal distances under the first travel control and under the second travel control denotes that the distance from the departure floor to the stop floor during the first travel control is equal to the distance from the departure floor to the stop floor during the second travel control. That is, in FIG. 5, an area surrounded by the graph of the speed change during the first travel control and the time axis is equal to an area surrounded by the graph of the speed change during the second travel control and the time axis. In order to implement the travel described above, specifically, for example, it is only necessary to use the same departure floor and the same stop floor in the first travel control and in the second travel control.

Similarly to Embodiment 1, the rope feed amount difference detection section 32 of the control panel 30 detects the difference in the amount of feed of the main rope 10 by the rotation of the sheave 20 based on the difference in the number of rotations of the sheave 20 when the elevator car 2 is caused to travel equal differences under the first travel control and under the second travel control. Subsequently, similarly to Embodiment 1, the determination section 34 of the control panel 30 determines the traction performance of the sheave 20 based on the difference in the amount of feed of the main rope 10 detected by the rope feed amount difference detection section 32.

However, in Embodiment 2, the acceleration/deceleration during the first travel control is equal to the acceleration/deceleration during the second travel control. Consequently, the value of the right side of (2) Expression shown in Embodiment 1 during the first travel control is the same as that during the second travel control. However, in the case where the "slippage" is present between the main rope 10 and the sheave 20 due to the reduction of the traction performance, the amount of the "slippage" is proportional to a length of time of occurrence of the "slippage". Accordingly, by reducing the acceleration/deceleration time, it is possible to reduce the total amount of the present "slippage".

In each of the first travel control and the second travel control, the "displacement" caused by the dynamic factor represented by (1) Expression shown in Embodiment 1 occurs. To cope with this, by evaluating the difference between the amount of feed of the main rope 10 during the first travel control and the amount thereof during the second travel control, it is possible to evaluate the amount of the "slippage" between the main rope 10 and the sheave 20 caused by the reduction of the traction performance from which the effect of the "displacement" caused by the dynamic factor represented by (1) Expression is excluded.

With these principles, in Embodiment 2 as well, the determination section 34 can exclude the effect of the "displacement" caused by the dynamic factor represented by (1) Expression, and determine the traction performance of the sheave 20 based on the amount of the "slippage" between the main rope 10 and the sheave 20 caused by the reduction of the traction performance.

Note that the other configurations are the same as those in Embodiment 1, and hence the detailed description thereof will be omitted.

The thus configured elevator diagnosing device includes the hoisting machine 5 that has the sheave 20 around which the middle portion of the main rope 10 that suspends the elevator car 2 is wound, and the control panel 30 as the control means for causing the elevator car 2 to travel by controlling the operation of the hoisting machine 5. The control panel 30 as the control means includes the car control section 31 that performs the first travel control that causes the elevator car 2 to travel with the first acceleration/deceleration time and the second travel control that causes the elevator car 2 to travel with the second acceleration/deceleration time that is shorter than the first acceleration/deceleration time, the rope feed amount difference detection section 32 that detects the difference in the amount of feed of the main rope 10 by the rotation of the sheave 20 when the elevator car 2 is caused to travel equal distances under the first travel control and under the second travel control, and the determination section 34 that determines the traction performance of the sheave 20 based on the difference in the amount of feed of the main rope 10 detected by the rope feed amount difference detection section 32. Accordingly, it is possible to achieve effects similar to those of Embodiment 1.

Embodiment 3

Figure 6:
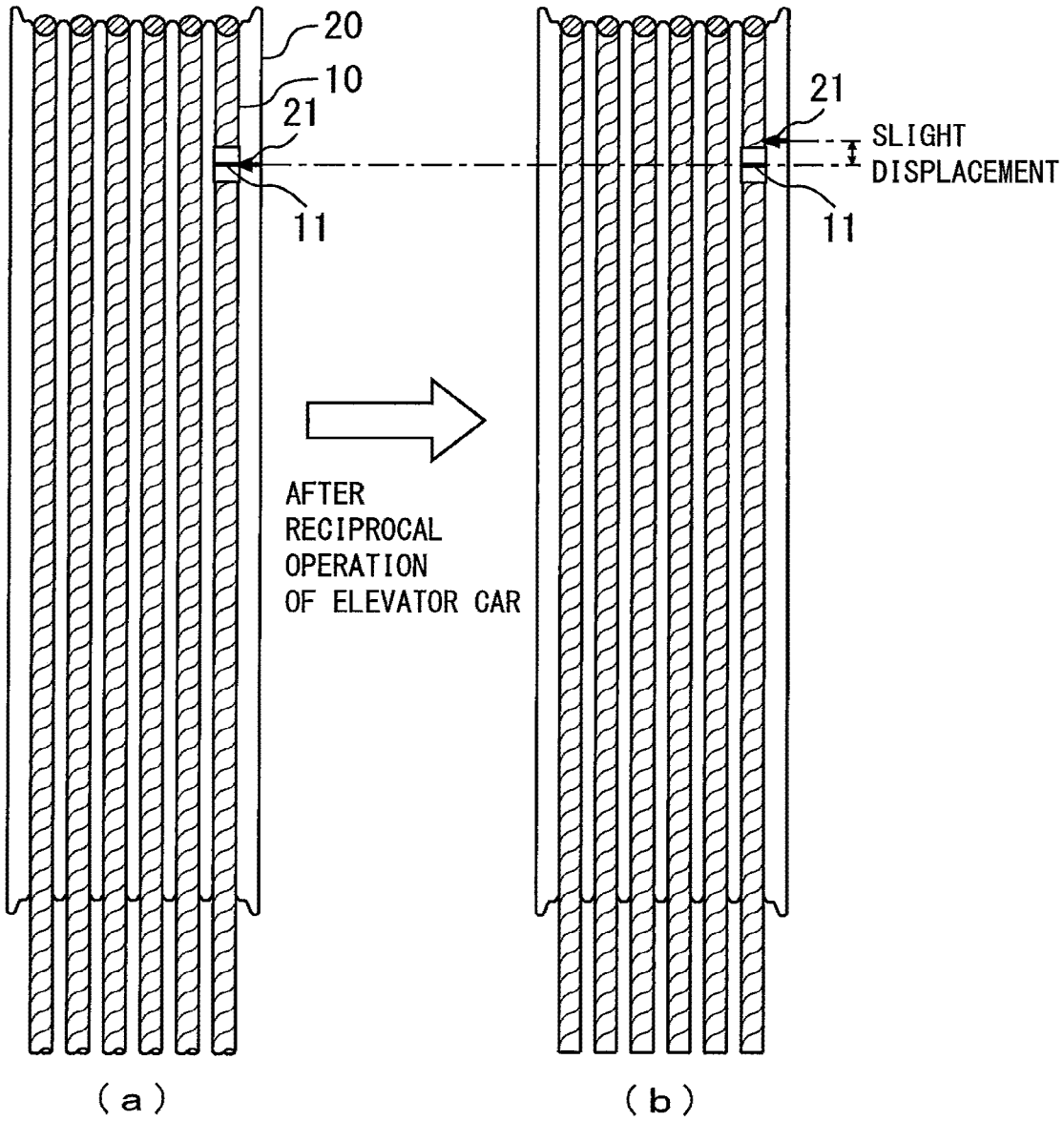
FIG. 6 is a view showing the main rope and the sheave of the elevator diagnosing device according to Embodiment 3 of the present invention.

FIG. 6 relates to Embodiment 3 of the invention, and is a view showing the main rope and the sheave of the elevator diagnosing device.

In each of Embodiment 1 and Embodiment 2 described above, in order to diagnose the traction performance, the difference in the amount of feed of the main rope 10 when the elevator car 2 is caused to travel equal distances under the first travel control and under the second travel control is detected. In Embodiment 3 described herein, in the configuration of Embodiment 1 or Embodiment 2 described above, as the travel of equal distances by the elevator car 2 for diagnosing the traction performance, reciprocal travel is used.

In Embodiment 3 as well, the basic configuration that includes the control system of the elevator diagnosing device is the same as that in Embodiment 1 or Embodiment 3, and hence Embodiment 3 will be described with reference to FIG. 2 used in the description of each of Embodiment 1 and Embodiment 2. The first car travel control section 41 of the car control section 31 performs the first travel control. In addition, the second car travel control section 42 of the car control section 31 performs the second travel control.

The rope feed amount difference detection section 32 of the control panel 30 detects the difference in the amount of feed of the main rope 10 by the rotation of the sheave 20 when the elevator car 2 is caused to travel equal distances under the first travel control and under the second travel control. The travel of equal distances by the elevator car 2 under the first travel control and under the second travel control is reciprocal travel between predetermined floors.

That is, in the diagnosis of the traction performance, the car control section 31 causes the elevator car 2 to perform the reciprocal travel under the first travel control in one of one way and the other way of the reciprocal travel and causes the elevator car 2 to travel under the second travel control in the other one of the one way and the other way of the reciprocal travel. Specifically, for example, the second car travel control section 42 of the car control section 31 causes the elevator car 2 to travel under the second travel control from the departure floor to the stop floor. Subsequently, the first car travel control section 41 of the car control section 31 causes the elevator car 2 to travel under the first travel control from the stop floor to the departure floor.

Thus, by causing the elevator car 2 to travel while the travel control in the one way is changed to the different travel control in the other way, it is possible to easily cause the elevator car 2 to travel equal distances under the first travel control and under the second travel control. Subsequently, the rope feed amount difference detection section 32 detects the difference in the amount of feed of the main rope 10 by the rotation of the sheave 20 when the elevator car 2 is caused to perform the reciprocal travel under the first travel control and under the second travel control. At this point, similarly to Embodiment 1 and Embodiment 2, the difference in the amount of feed of the main rope 10 may be detected based on the difference in the number of rotations of the sheave 20, but the difference therein may also be detected in the following manner.

That is, when the elevator car 2 is caused to perform the reciprocal operation and is returned to the departure floor, the rotational phase angle of the sheave 20 is inevitably returned to its state before the departure under ideal conditions. Accordingly, in Embodiment 3, it is possible to determine the difference in the amount of feed of the main rope by using a difference between the rotational phase angle of the sheave 20 before the reciprocal travel and the rotational phase angle thereof after the reciprocal travel. Accordingly, the rope feed amount difference detection section 32 detects the difference in the amount of feed of the main rope 10 based on the difference in the rotational phase angle of the sheave 20 when the elevator car 2 is caused to perform the reciprocal travel under the first travel control in one of one way and the other way the reciprocal travel and under the second travel control in the other one of the one way and the other way thereof.

A first example of the detection of the difference in the amount of feed of the main rope 10 based on the difference in the rotational phase angle of the sheave 20 is a method that uses the detection result of the encoder 6. As described in Embodiment 1, the encoder 6 can output the signal in accordance with the rotational phase angle of the sheave 20, and detect not only the number of rotations of the sheave 20 but also the rotational phase angle of the sheave 20. Consequently, the rope feed amount difference detection section 32 can detect the difference in the rotational phase angle of the sheave 20 by using the detection result of the encoder 6.

Next, a second example of the detection of the difference in the amount of feed of the main rope 10 based on the difference in the rotational phase angle of the sheave 20 will be described with reference to FIG. 6. As shown in FIG. 6, in the second example, a rope-side mark 11 is provided at a predetermined position of the main rope 10. In addition, a sheave-side mark 21 is provided at a predetermined position of the sheave 20.

The rope feed amount difference detection section 32 detects the difference in the amount of feed of the main rope 10 based on the change of relative positions of the rope-side mark 11 and the sheave-side mark 21 when the elevator car 2 is caused to perform the reciprocal travel under the first travel control in one of one way and the other way of the reciprocal travel and under the second travel control in the other one of the one way and the other way thereof. The difference in the amount of feed of the main rope 10 is detected based on the change of the relative positions of the rope-side mark 11 and the sheave-side mark 21 when the elevator car is caused to perform the reciprocal travel under the first travel control and under the second travel control.

For example, it is assumed that the rope-side mark 11 and the sheave-side mark 21 are at the same position before the reciprocal travel as shown in FIG. 6(*a*), and the positions of the rope-side mark 11 and the sheave-side mark 21 are slightly displaced from each other before the reciprocal travel as shown in FIG. 6(*b*). In this case, it is possible to obtain the difference between the rotational phase angle of the sheave 20 before the reciprocal travel and the rotational phase angle thereof after the reciprocal travel by using the slight displacement shown in FIG. 6(*b*).

Herein, it is possible to detect the relative positions of the rope-side mark 11 and the sheave-side mark 21 by, e.g., processing of an image of the main rope 10 and the sheave 20 taken by a camera or the like. In addition, it goes without saying that the change of the relative positions of the rope-side mark 11 and the sheave-side mark 21 after the reciprocal travel from those before the reciprocal travel can be visually recognized by the maintenance personnel or the like.

Note that the other configurations are the same as those in Embodiment 1 or Embodiment 2, and hence the detailed description thereof will be omitted.

In the thus configured elevator diagnosing device, in the configuration of Embodiment 1 or Embodiment 2, the rope feed amount difference detection section 32 detects the difference in the amount of feed of the main rope 10 based on the difference in the rotational phase angle of the sheave 20 when the elevator car 2 is caused to perform the reciprocal travel under the first travel control in one of one way and the other way of the reciprocal travel and under the second travel control in the other one of the one way and the other way thereof.

Accordingly, it is possible to achieve effects similar to those of Embodiment 1 or Embodiment 2 and, in addition, it is possible to perform the diagnosis of the traction performance based on the difference between the rotational phase angle of the sheave before the reciprocal travel and the rotational phase angle thereof after the reciprocal travel more easily.

INDUSTRIAL APPLICABILITY

The invention can be used in the elevator diagnosing device that diagnoses the traction performance of the traction type elevator that includes the hoisting machine that has the sheave around which the middle portion of the main rope that suspends the elevator car is wound.

REFERENCE SIGNS LIST

1 Shaft
2 Elevator car
3 Balance weight
4 Deflector sheave
5 Hoisting machine
6 Encoder
10 Main rope
11 Rope-side mark
20 Sheave
21 Sheave-side mark
30 Control panel
31 Car control section
32 Rope feed amount difference detection section
33 Storage section
34 Determination section
35 Notification section
41 First car travel control section
42 Second car travel control section

The invention claimed is:

1. An elevator diagnosing device comprising:

a hoisting machine including a sheave around which a middle portion of a main rope that suspends an elevator car is wound; and a control panel configured to cause the elevator car to travel by controlling an operation of the hoisting machine, wherein the control panel includes:

a car control section configured to perform first travel control that causes the elevator car to travel at a first acceleration/deceleration and second travel control that causes the elevator car to travel at a second acceleration/deceleration, the second acceleration/deceleration being less than the first acceleration/deceleration;

a rope feed amount difference detection section configured to detect a difference in an amount of feed of the main rope by rotation of the sheave when the elevator car is caused to travel equal distances under the first travel control and under the second travel control; and a determination section configured to determine traction performance of the sheave, based on the difference in the amount of feed of the main rope detected by the rope feed amount difference detection section.

2. The elevator diagnosing device according to claim 1, wherein the rope feed amount difference detection section detects the difference in the amount of feed of the main rope, based on a difference in a number of rotations of the sheave when the elevator car is caused to travel equal distances under the first travel control and under the second travel control.

3. The elevator diagnosing device according to claim 1, wherein the rope feed amount difference detection section detects the difference in the amount of feed of the main rope, based on a difference in a rotational phase angle of the sheave when the elevator car is caused to perform reciprocal travel under the first travel control in one of one way and the other way of the reciprocal travel and under the second travel control in the other one of the one way and the other way of the reciprocal travel.

4. The elevator diagnosing device according to claim 2, further comprising:

an encoder configured to detect the number of rotations of the sheave, wherein the rope feed amount difference detection section detects the difference in the amount of feed of the main rope by using a detection result of the encoder.

5. The elevator diagnosing device according to claim 4, further comprising:

an encoder configured to detect the rotational phase angle of the sheave, wherein the rope feed amount difference detection section detects the difference in the amount of feed of the main rope by using a detection result of the encoder.

6. The elevator diagnosing device according to claim 1, wherein a rope-side mark is provided at a predetermined position of the main rope, a sheave-side mark is provided at a predetermined position of the sheave, and the rope feed amount difference detection section detects the difference in the amount of feed of the main rope, based on a change of relative positions of the rope-side mark and the sheave-side mark when the elevator car is caused to perform reciprocal travel under the first travel control in one of one way and the other way of the reciprocal travel and under the second travel control in the other one of the one way and the other way of the reciprocal travel.

7. The elevator diagnosing device according to claim 1, wherein the car control section causes the elevator car to travel at an acceleration/deceleration that is less than an acceleration/deceleration during a normal operation after determination is made that the traction performance of the sheave is lower than a predetermined reference by the determination section.

8. The elevator diagnosing device according to claim 1, wherein the car control section causes the elevator car to travel at a maximum speed that is less than a maximum speed during the normal operation after determination is made that the traction performance of the sheave is lower than the predetermined reference by the determination section.

9. The elevator diagnosing device according to claim 1, wherein the first travel control and the second travel control by the car control section, the detection of the difference in the amount of feed of the main rope by the rope feed amount difference detection section, and the determination of the traction performance of the sheave by the determination section are performed during a preset time period in which an elevator is not used.

10. An elevator diagnosing device comprising:

a hoisting machine including a sheave around which a middle portion of a main rope that suspends an elevator car is wound; and a control panel configured to cause the elevator car to travel by controlling an operation of the hoisting machine, wherein the control panel includes:

a car control section configured to perform first travel control that causes the elevator car to travel with a first acceleration/deceleration time and second travel control that causes the elevator car to travel with a second acceleration/deceleration time, the second acceleration/deceleration time being shorter than the first acceleration/deceleration time;

a rope feed amount difference detection section configured to detect a difference in an amount of feed of the main rope by rotation of the sheave when the elevator car is caused to travel equal distances under the first travel control and under the second travel control; and a determination section configured to determine traction performance of the sheave, based on the difference in the amount of feed of the main rope detected by the rope feed amount difference detection section.

11. The elevator diagnosing device according to claim 10, wherein the rope feed amount difference detection section detects the difference in the amount of feed of the main rope, based on a difference in a number of rotations of the sheave when the elevator car is caused to travel equal distances under the first travel control and under the second travel control.

12. The elevator diagnosing device according to claim 10, wherein the rope feed amount difference detection section detects the difference in the amount of feed of the main rope, based on a difference in a rotational phase angle of the sheave when the elevator car is caused to perform reciprocal travel under the first travel control in one of one way and the other way of the reciprocal travel and under the second travel control in the other one of the one way and the other way of the reciprocal travel.

13. The elevator diagnosing device according to claim 11, further comprising:

an encoder configured to detect the number of rotations of the sheave, wherein the rope feed amount difference detection section detects the difference in the amount of feed of the main rope by using a detection result of the encoder.

14. The elevator diagnosing device according to claim 12, further comprising:

an encoder configured to detect the rotational phase angle of the sheave, wherein the rope feed amount difference detection section detects the difference in the amount of feed of the main rope by using a detection result of the encoder.

15. The elevator diagnosing device according to claim 10, wherein a rope-side mark is provided at a predetermined position of the main rope, a sheave-side mark is provided at a predetermined position of the sheave, and the rope feed amount difference detection section detects the difference in the amount of feed of the main rope, based on a change of relative positions of the rope-side mark and the sheave-side mark when the elevator car is caused to perform reciprocal travel under the first travel control in one of one way and the other way of the reciprocal travel and under the second travel control in the other one of the one way and the other way of the reciprocal travel.

16. The elevator diagnosing device according to claim 10, wherein the car control section causes the elevator car to travel at an acceleration/deceleration that is less than an acceleration/deceleration during a normal operation after determination is made that the traction performance of the sheave is lower than a predetermined reference by the determination section.

17. The elevator diagnosing device according to claim 10, wherein the car control section causes the elevator car to travel at a maximum speed that is less than a maximum speed during the normal operation after determination is made that the traction performance of the sheave is lower than the predetermined reference by the determination section.

18. The elevator diagnosing device according to claim 10, wherein the first travel control and the second travel control by the car control section, the detection of the difference in the amount of feed of the main rope by the rope feed amount difference detection section, and the determination of the traction performance of the sheave by the determination section are performed during a preset time period in which an elevator is not used.

* * * * *